United States Patent [19]

Dabney

[11] Patent Number: 4,867,424

[45] Date of Patent: Sep. 19, 1989

[54] BOX SPRING WITH WIRE COLUMNS AND PARTIAL COILS

[75] Inventor: Upton R. Dabney, Georgetown, Ky.

[73] Assignee: Hoover Group, Inc., Roswell, Ga.

[21] Appl. No.: 248,048

[22] Filed: Sep. 23, 1988

[51] Int. Cl.[4] ..... A47C 23/043

[52] U.S. Cl. ..... 267/103; 5/246

[58] Field of Search ..... 5/246, 247, 248; 267/91, 103, 107, 108, 109, 110

[56] References Cited

U.S. PATENT DOCUMENTS

| | | | |
|---|---|---|---|
| 3,657,749 | 4/1972 | Norman | 5/248 X |
| 3,852,838 | 12/1974 | Slominski et al. | 5/247 |
| 4,662,011 | 5/1987 | Duvivier | 5/246 X |
| 4,726,572 | 2/1988 | Flesher et al. | 267/103 X |

FOREIGN PATENT DOCUMENTS

| | | | |
|---|---|---|---|
| 0082259 | 6/1983 | European Pat. Off. | 5/246 |

*Primary Examiner*—Duane A. Reger

*Attorney, Agent, or Firm*—Harness, Dickey & Pierce

[57] ABSTRACT

A box spring assembly that comprises a rectangular frame and a mattress support deck above the frame is supported by a plurality of deck support springs arranged between the deck and the frame. Each spring has a deck attaching portion, a yieldable portion, and a foot portion. The yieldable portion of the springs comprises a coil spring portion joining a wire column portion having one or more straight torsion bar portions thereby combining the characteristics of limited deflection columns and for torsion bars with the equalized torsional stresses of a coil spring to provide improved impact withstand capability and improved impact loading response and a soft firmness in a box spring assembly.

23 Claims, 5 Drawing Sheets

BOX SPRING WITH WIRE COLUMNS AND PARTIAL COILS

BACKGROUND AND SUMMARY OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assemblies are: U.S. Pat. Nos. 3,487,480; 3,506,987; 3,574,240; 3,574,241; 3,665,529; 3,620,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,371,152; 4,398,705; 4,470,584; 4,452,438; and 4,739,977.

Box spring assemblies of the general type shown in the above list of patents all of which are owned by the assignee of this application, are advantageous with respect to the conventional box spring assemblies using coil springs because they provided as desired stiffer foundation for the mattress and contain a reduced amount of wire. These box spring assemblies are also advantageous from the standpoint of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

The above list of patents utilize springs made of formed spring wire having various torsion bar arrangements. The present invention replaces one of these torsion bar portions with a coil spring portion to evenly distribute torsional stresses under working and impact loads. The present invention further utilizes limited deflection wire columns to prevent total collapse of the box spring and to provide improved shock resistance.

The box spring according to the present invention includes a generally horizontal rectangular frame and a horizontal mattress support deck disposed a predetermined distance above the frame. The deck includes straight deck wires arranged in a crisscross fashion, some of which extend lengthwise of the frame and others which extend crosswise. Bounding the crisscrossed deck wires is a border wire located in the same plane as the deck wires and substantially vertically aligned with the frame below.

Between the mattress support deck and the frame are a plurality of deck support springs which yieldably support the deck on the frame. Each spring has a deck attaching portion attached to the deck wires with clips in a conventional manner and a pair of vertically yieldable portions connected between the deck and the frame. The vertically yieldable portion has a vertically spiraling coil spring portion in series with an upright column portion and a foot portion. The coil spring portion is connected between the attaching portion and the upright column portion which joins the coil spring portion with the foot portion.

The combination of a coil spring with the wire column results in a box spring assembly having softer firmness, feel and floatation characteristics than those attainable in a box spring assembly utilizing only torsion bar springs. The result is an improved box spring assembly having the increased shock resistance characteristic of a limited deflection column and the firmness and floatation characteristics of a coil spring assembly.

Further objects, features, and advantages of this invention will become apparent from a consideration of the following description, the appended claims, and the accompanying drawing.

DETAILED DESCRIPTION OF THE PREFERRED EMBODIMENTS

Figure 1:
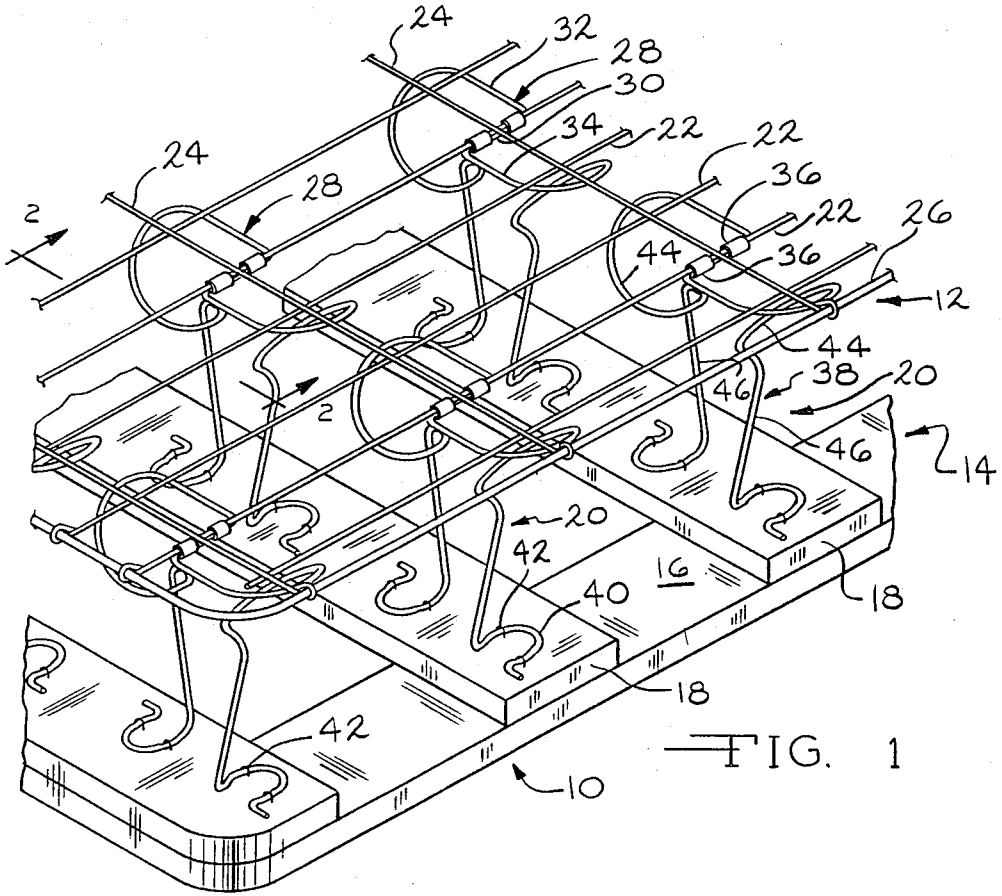
FIG. 1 is a fragmentary perspective view of one embodiment of the box spring assembly according to the present invention.

One preferred embodiment of a box spring assembly in accordance with this invention is shown in FIG. 1 and is generally designated by reference numeral 10. Box spring assembly 10 includes a mattress support deck 12 spaced above and in parallel alignment with a wood frame 14 which is of rectangular shape having side members 16 and cross members 18. Mattress support deck 12 is supported from the frame 14 by a plurality of deck support springs 20.

The mattress support deck 12 comprises a plurality of long wires 22 spaced apart in parallel relation and a plurality of cross wires 24 at right angles to the long wires, and spaced apart over the length of frame 14. The long wires 22 and the cross wires 24 are welded together at the intersections of the wires forming a welded grid in a plane and are terminated by being bent around a border wire 26 which extends around the perimeter of the mattress support deck 12 and in spaced relation to the wood frame 14.

Each of the deck support springs 20 comprises a deck attaching portion 28 comprising an intermediate attaching section 30 extending between a pair of horizontal connecting sections 32 and 34. The attaching portion 28 lies generally in the plane of the mattress support deck 12. The intermediate deck attaching section 30 is positioned parallel to one of the long wires 22 and directly under an intersection with the cross wire 24 so that the intermediate attaching section 30 supports and is centered beneath the cross wire 24. The intermediate deck attaching section 30 is secured to the long wire 22 with a pair of conventional wire clips 36 which clamp around both the intermediate deck attaching section 30 and the long wire 22, one on either side of the intersecting cross wire 24.

The horizontal connecting section 32 is bent at right angles to the intermediate attaching section 30 in the plane of the mattress support deck 12 thus extending parallel to the cross wires 24. Similarly, the other horizontal connecting section 34 is bent at the opposite right angle to the intermediate attaching section 30 and also extends parallel to the grid cross wires 24, but in the opposite direction as does the connecting section 32.

The horizontal connecting sections 32 and 34 each join with a downwardly extending yieldable portion 38 which terminates in a foot portion 40. The foot portions 40 are generally U-shape horizontal sections of the terminal ends of deck springs 20. The foot portions 40 may be fastened to wood frame 14 via staples 42. Alternatively, if the cross members are made of steel spans as shown in the preferred embodiment in FIG. 3, foot portions 40 may be suitably secured in the slots in the steel spans.

Each of the yieldable portions 38 of each deck support spring 20 has an upper coil portion 44 and a lower upright column portion 46 joining foot portion 40. Each upright column portion 46 has a downwardly curved horizontal moment arm 48 at the upper end joining upright column portion 46 with the lower end of the coil spring portion 44. The upper end of each coil spring portion 44 joins one of the connecting sections 32 or 34 of the deck attaching portion 28.

Figure 2:
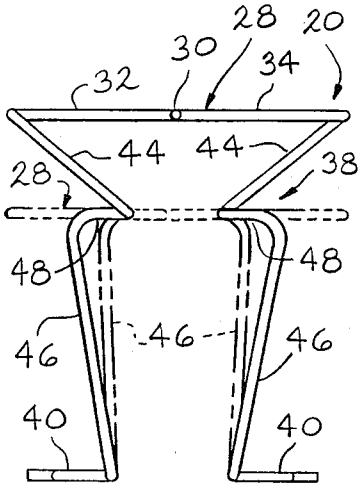
FIG. 2 is a side view of one of the deck support springs taken along the line 2—2 in FIG. 1.

As a downwardly directed load is applied to the mattress support deck 12, the coil spring portions 44 are compressed. The moment arms 48 rotate outward, absorbing some of the torsional load from the coil spring portions 44 and transferring it to the column portions 46 as the column portions 46 deflect toward each other and toward an upright vertical orientation as shown by the broken lines in FIG. 2. This rotation causes upright columns 46 to also be placed in torsion, absorbing an additional part of the load. When the load on the mattress support deck 12 is further increased, the coil spring portions 44 become fully deflected and the upper ends of the upright column portions 46 joining moment arms 48 contact the mattress support deck 12 limiting the amount of deflection of the spring to less than the amount necessary to cause it to take a set. This is accomplished by transferring stress build up directly to the columns 46 via the moment arms 48.

Thus this embodiment of the present invention couples a limited deflection spring with a moment arm at the top of each upright column 46 with the smooth deflection characteristics of the coil spring portion 44 to equalize the torsional stresses under the working and impact loads during deflection and to prevent stress concentration. This also provides the softer firmness and floatation characteristics of a coil spring system combined with a true limited deflection column.

The upright column portions 46 provide a true limited deflection column as the upright column portions 46 move to the vertical orientation during deflection. Deflection terminates when the upright column portions 46 attain a generally vertical orientation and contact the mattress support deck 12 as shown by the broken lines in FIG. 2. The limited deflection of upright column portions 46 thus prevent total collapse of the box spring assembly 10 under load.

Figure 3:
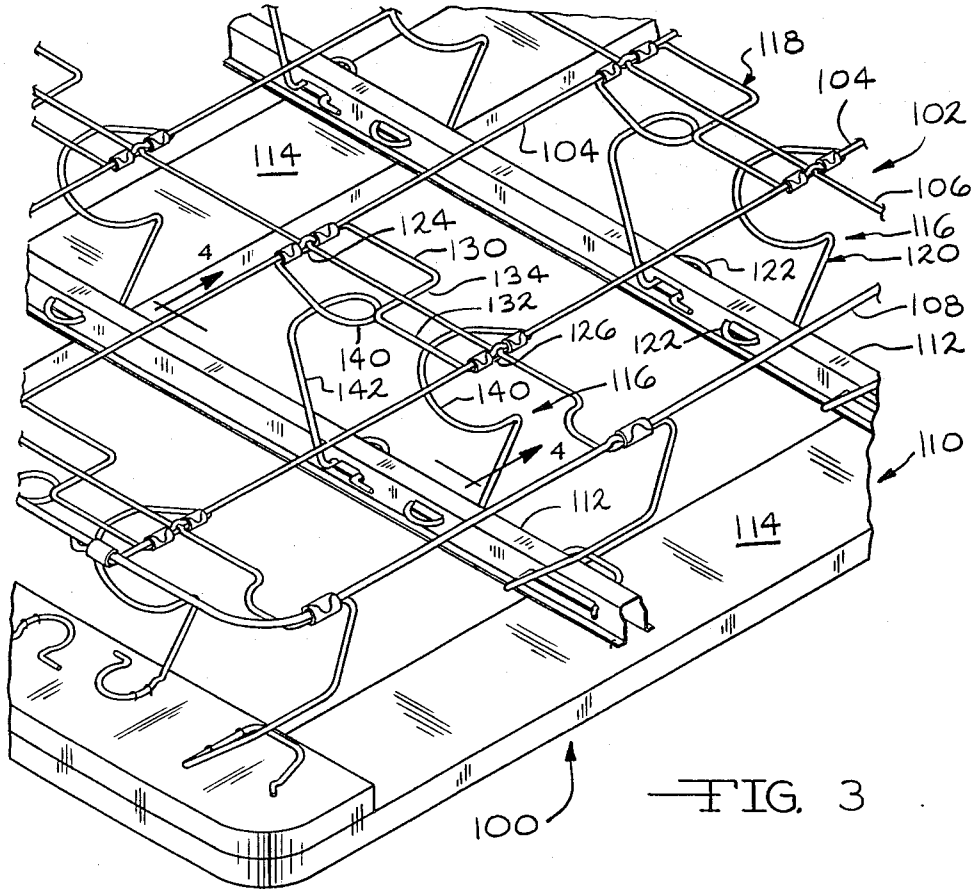
FIG. 3 is a fragmentary perspective view of another embodiment of the box spring assembly according to the present invention.

Another embodiment of the box spring assembly of this invention, indicated generally at 100 in FIG. 3, comprises a mattress support deck 102 having criss-crossed interlocked long and cross wires 104 and 106, respectively, bounded by a border wire 108. Mattress support deck 102 is positioned generally horizontally spaced above a frame 110 having a plurality of steel span cross members 112 attached to frame rails 114. A plurality of deck support springs 116 are disposed between the frame 110 and the mattress support deck 102. Each spring 116 is formed from a single piece of spring wire.

Each spring has a deck attaching portion 118, a pair of yieldable portions 120 extending downward from the deck attaching portion 118 and terminating in foot portions 122 which are secured to frame 110.

Figure 4:
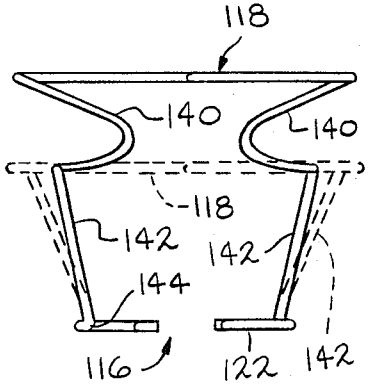
FIG. 4 is a side view of one of the deck support springs taken along the line 4—4 in FIG. 3.
Figure 5:
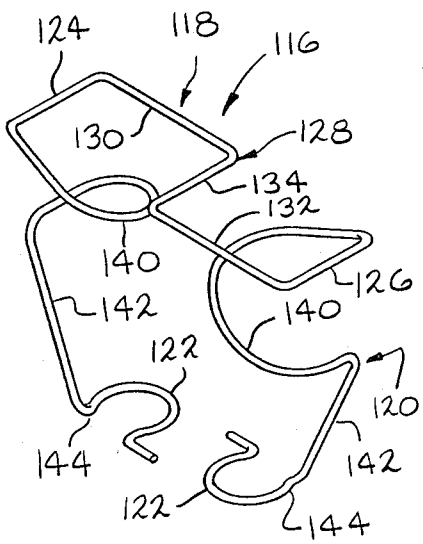
FIG. 5 is a perspective view of a deck support spring used in the embodiment shown in FIG. 3.

A side view of the spring 116 is separately shown in FIG. 4 and a perspective view of the same spring is shown in FIG. 5. The deck attaching portion 118 is a generally horizontal planar wire portion having a pair of straight torsion bars 124 and 126, one end of each joining with yieldable portion 120. The other ends of torsion bars 124 and 126 are connected together via a connecting portion 128. Torsion bars 124 and 126 are generally parallel to one another and positioned adjacent and parallel to a pair of long wires 104.

Connecting section 128 comprises a pair of parallel connecting sections 130 and 132 which extend perpendicularly from opposite ends of each torsion bar 124 and 126 respectively. Connecting sections 130 and 132 are then joined together by an intermediate section 134.

Attaching portion 118 is positioned beneath and against the mattress support deck 102 as shown in FIG. 3 with torsion bars 124 and 126 positioned under a pair of intersections 136 between the long and cross wires 104 and 106. A pair of clips 138 secures each torsion bar to the adjacent long wire 104 passing above on either side of the intersecting cross wire 106.

As best shown in FIGS. 4 and 5, yieldable portions 120 include a pair of downwardly spiraling coil spring portions 140 connected to the torsion bars 124 and 126. The lower ends of the coil spring portions 140 merge with a pair of downwardly converging upright column portions 142. The lower ends of the upright column portions 142 join with a pair of torsion bars 144 which each form part of the foot portions 122.

As a downwardly directed load is applied to the mattress support deck 102, the coil spring portions 140 are compressed. The coil spring portions 140 evenly distribute the applied torsional forces when a downward load is applied minimizing stress concentrations. The torsion bars 144 twist deflecting the upright columns 142 outward to absorb the applied load. In addition, a portion of the torsional load is transferred to the upright columns 142 during spring compression, as a bending moment.

The upper ends of upright columns 142 further diverge as the applied load is increased, as shown by the dashed lines in FIG. 4, in contrast to the previous embodiment where the upright columns converge toward an upright vertical position under increased load. The embodiment shown in FIGS. 3, 4 and 5 thus allows further deflection under full loading conditions and may be desirable in some box spring designs. The embodiment shown in FIGS. 3, 4 and 5 also combines the stress and strain characteristics of a coil spring with the more rigid platform characteristics of a spring using straight torsion bars.

Figure 6:
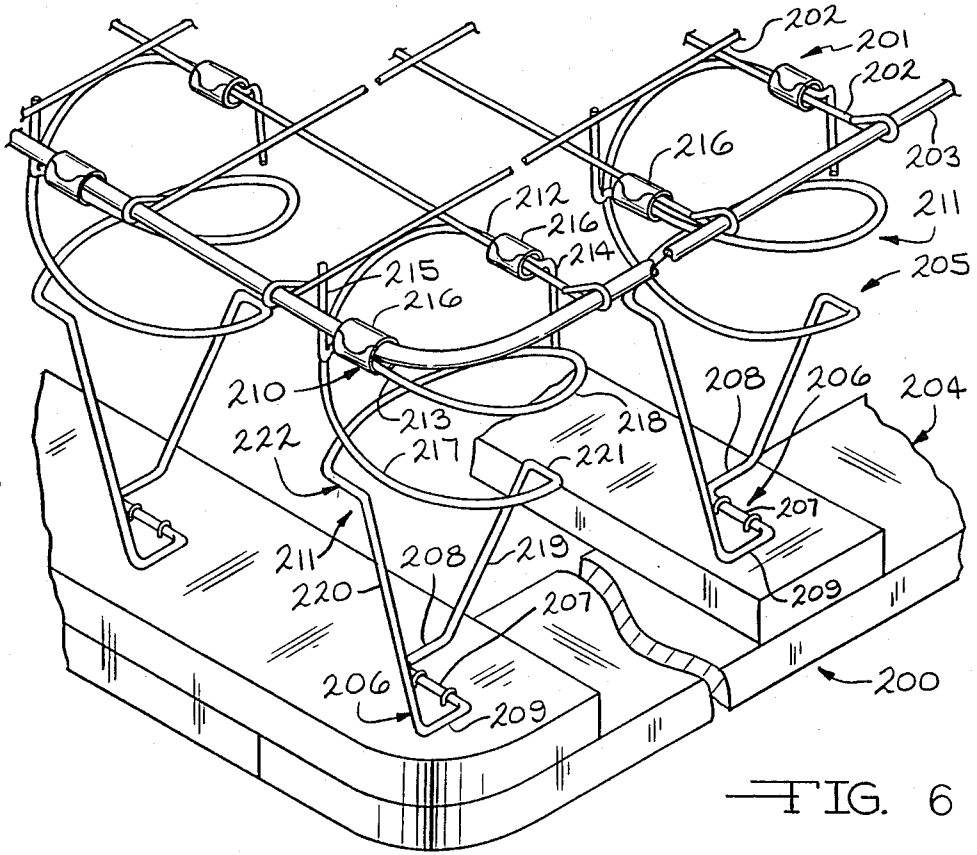
FIG. 6 is a fragmentary perspective view of a third embodiment of the present invention incorporating an open top coil spring portion.

A third preferred embodiment of the box spring assembly of this invention, identified generally at 200, is shown in FIG. 6. The box spring assembly 200 comprises a mattress support deck 201 comprising criss-crossed deck wires 202 attached to a border wire 203, a frame 204, and a plurality of deck support springs 205.

Each of the springs 205 comprises a single piece of spring wire having an upper end and a midspaced foot portion 206 at the lower end. The foot portion 206 has a base bar 207 stapled or otherwise secured to frame 204 and a pair of lower torsion bars 208 and 209 extending from base bar 207 in a generally perpendicular direction to the base bar and lying in the plane of the base bar 207 adjacent the frame 204.

Figure 7:
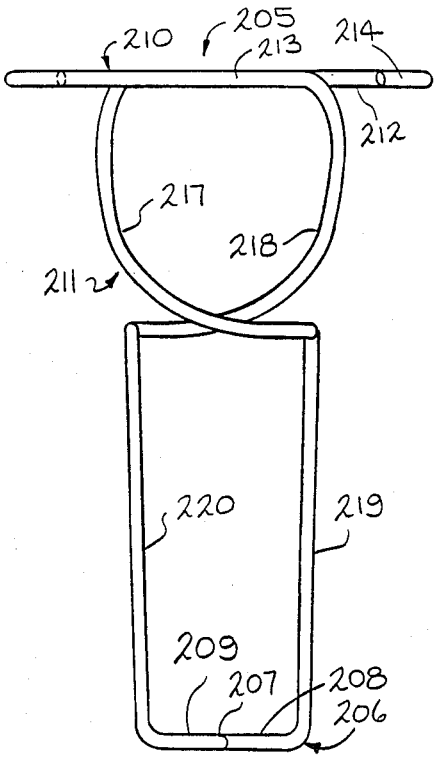
FIG. 7 is a side view of an isolated deck support spring used in the embodiment shown in FIG. 6.
Figure 8:
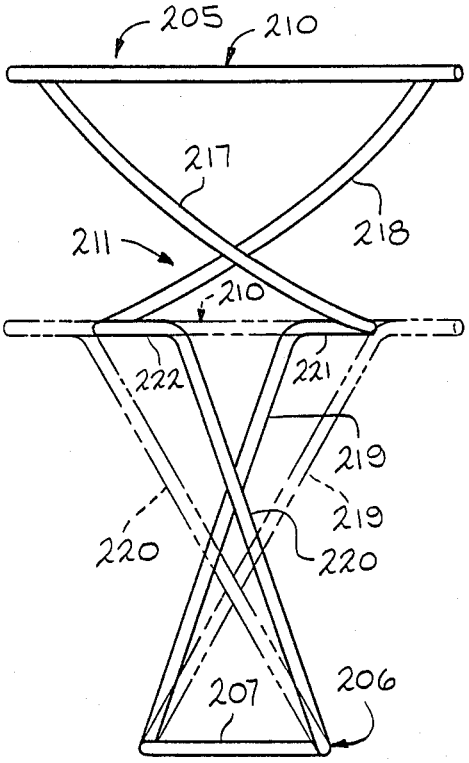
FIG. 8 is a side view of the spring shown in FIG. 6 as seen in the direction 8—8 in FIG. 7.

Two orthogonal side views of a single spring 205 separated from the box spring assembly 200 are illustrated in FIGS. 7 and 8. Each spring 205, in addition to having the midspaced foot portion 206 at the lower end comprises a generally horizontal deck attaching portion 210 at the upper end and a yieldable portion 211 inbetween.

The deck attaching portion 210 comprises attaching bars 212 and 213 joining end bars 214 and 215. End bars 214 and 215 extend at an obtuse angle from attaching bars 212 and 213, respectively. End bars 214 and 215, when attaching bars 212 and 213 are clipped to cross wires 202 with clips 216, engage perpendicular deck wires 202 or border wires 203 to prevent free rotation of the attaching bars 212 and 213. These end bars thus cause attaching bars 212 and 213 to become upper torsion bars when a downward load is applied to the mattress support deck 201. In addition, they provide support for adjacent weld intersections of deck wires 202.

The yieldable portion 211 of spring 205 includes a pair of helical coil spring portions 217 and 218, a pair of upright columns 219 and 220, and a pair of horizontal upper moment arms 221 and 222, respectively, integrally joining the coil spring portions to the upright columns. The lower ends of upright columns 219 and 220 join the lower torsion bars 208 and 209. The upper end of the upright columns 219 and 220 join the moment arms 221 and 222, respectively. The helical spring portions 217 and 218 respectively extend downward from the attaching bars 212 and 213.

When a load is applied to the mattress support deck 201, the helical spring portions 217 and 218 deflect to the dashed line position shown in FIG. 8 while the upright columns 219 and 220 bend further away from the vertical orientation to the fully deflected position shown in dashed lines. The applied torsional load on the coil spring portion is partially transferred to the upright columns causing the deflection of the upright columns. This more evenly distributes the total load producing an improved impact loading response by the spring 205. As the helical spring portions 217 and 218 are compressed, the moment arms 221 and 222 are rotated outward placing columns 219 and 220 in torsion. Thus some of the impact load on the spring is resisted by column in torsion. This enables the spring to resist impact loads providing the improved response.

Figure 9:
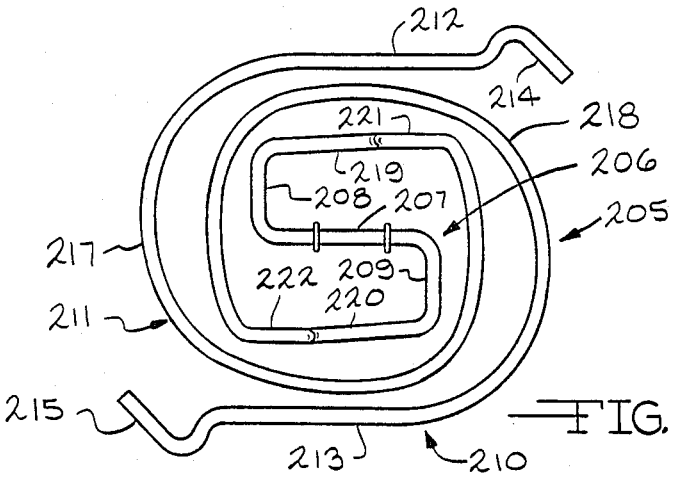
FIG. 9 is a plan view of the deck support spring shown in FIG. 6.

As shown in the plan view of spring 205 in FIG. 9, the spring 205 circumscribes an area which increases progressively from the foot portion 206 to the yieldable portion 211 and the deck attaching portion 210. In addition, columns 219 and 220 are slightly divergent as seen in FIGS. 7 and 9. The spring thus outlines an unobstructed inside cavity whereby several of the springs may be stacked together. This facilitates efficient storage and handling of multiple springs during assembly of the box spring.

Figure 10:
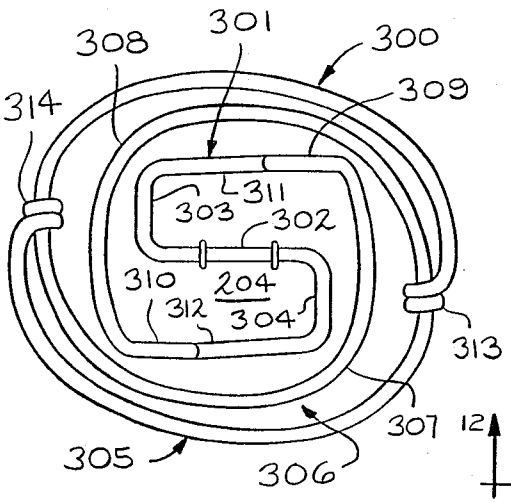
FIG. 10 is a plan view of a deck support spring according to a fourth preferred embodiment of the present invention.

FIG. 10 illustrates an isolated view of a fourth embodiment 300 of the spring according to the present invention identical to the spring 205 of the third embodiment above described with the exception of the deck attaching portion at the upper end of the spring. In this fourth embodiment, the deck support spring 300 comprises a single piece of spring wire having upper ends and a midspaced foot portion 301 at the lower end. The foot portion 301 has a base bar 302 stapled or otherwise secured to frame 204 and a pair of lower torsion bars 303 and 304 extending from base bar 302 in a generally perpendicular direction to the base bar 302 and lying in the plane of the base bar against frame 204.

Each spring 300, in addition to having midspaced foot portion 301 at the lower end, comprises a generally horizontal deck attaching portion 305 at the upper ends and a yieldable portion 306 inbetween.

The yieldable portion 306 comprises a pair of helical coil spring portions 307 and 308 wound in the same direction extending downward from deck attaching portion 305. Spring portions 307 and 308 are connected to moment arms 309 and 310 which in turn connect to upright columns 311 and 312 which join torsion bars 303 and 304 respectively.

The deck attaching portion 305 comprises hooked ends 313 and 314 terminating coil spring portions 307 and 308. Ends 313 and 314 are wrapped around and secured to adjacent portions 308 and 307, respectively, to form a closed circular top.

The deck support spring 300 is specifically designed to replace conventional coil spring units in production box springs designed for coil springs. The closed circular top or deck attaching portion 305 may be made in standard diameters to clip on to a conventional wire deck. The deck support spring 300 thus provides a limited deflection coil spring replacement having improved impact loading resistance over conventional coil spring assemblies.

Figure 12:
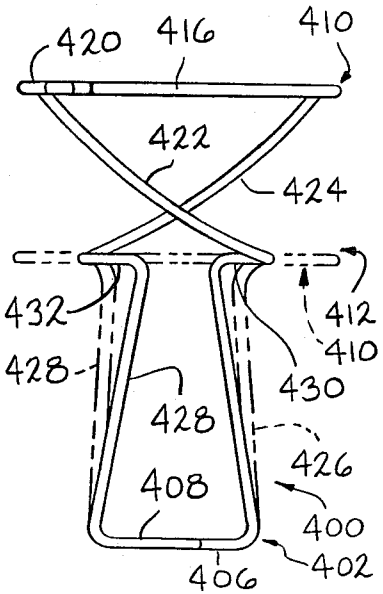
FIG. 12 is a side view of the spring shown in FIG. 11 as viewed from the direction 12—12 in FIG. 11.
Figure 11:
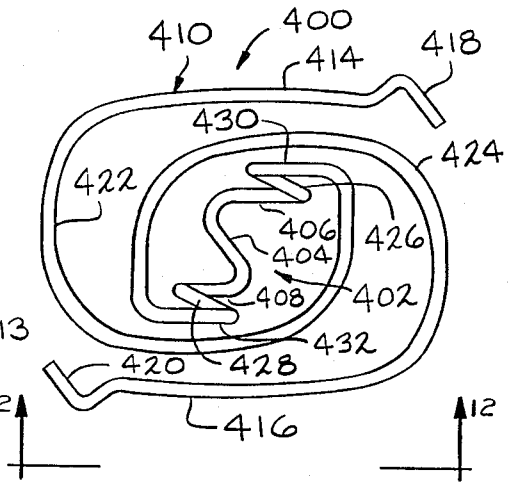
FIG. 11 is a plan view of a fifth preferred embodiment of the present invention.

A fifth embodiment of the present invention is illustrated in the plan and elevation views of FIGS. 11 and 12. The spring in this embodiment, generally indicated as 400, is designed for use in a box spring assembly similar to that shown in FIG. 6 with springs 400 replacing springs 205.

The deck support spring 400 comprises a single piece of spring wire having an upper end and a midspaced foot portion 402 at the lower end. The foot portion 402 has a base bar 404 which is stapled or otherwise secured to the frame 204, and a pair of lower base bars 406 and 408 which are generally parallel to each other forming foot portion 402 having a zig-zag shape.

Each spring 400, in addition to having the midspaced foot portion 402 at the lower end, comprises a generally horizontal deck attaching portion 410 at the upper end and a yieldable portion 412 inbetween. The deck attaching portion 410 comprises attaching bars 414 and 416 joining end bars 418 and 420 which extend at an obtuse angle from each of the attaching bars 414 and 416 respectively. These end bars serve the same purpose as in the third embodiment described above.

The yieldable portion 412 of spring 400 comprises a pair of helical coil spring portions 422 and 424 extending downward from the attaching bars 414 and 416, a pair of upright columns 426 and 428, and a pair of horizontal moment arms 430 and 432 integrally joining the coil spring portions 422 and 424 to the upright columns 426 and 428 respectively. The lower ends of upright columns 426 and 428 integrally join bars 406 and 408, respectively, in base portion 402.

When a downwardly directed load is applied to spring 400 compressing the upper end toward the lower end, the helical spring portions 422 and 424 deflect downward while the upright columns 426 and 428 are twisted and deflected toward a vertical orientation to the fully deflected position as shown by the dashed lines in FIG. 12. The applied torsional load on the coil spring portion is partially transferred to the upright columns 426 and 428 during deflection. This causes torsional loading of the upright columns more evenly distributing the total load over the parts of the spring, thus improving the impact loading response of the spring 400.

Thus it can be seen from the preferred embodiments above described, that the spring according to the present invention combines the torsion bar characteristics inherent in a non-coil spring assembly with the soft flotation characteristics of a coil spring by replacing some of the straight torsion bars and connecting bars with a coil spring portion to achieve equalization of torsional stresses under working and impact loads. This spring design also provides a flexible yet firm suspension system. Also, in the preferred embodiments, a limited deflection column feature prevents total collapse under severe load and provides improved shock resistance.

While the above description constitutes the preferred embodiments of the present invention, it will be appreciated that the inventive adaptation of coil springs with torsion bar and column spring construction to achieve improved distribution of bedding loads is susceptible to modification, variation and change without departing from the proper scope and fair meaning of the accompanying claims.

What is claimed is:

1. A box spring assembly comprising:

a generally horizontal rectangular frame;

a generally horizontal mattress support deck disposed a predetermined distance above said frame; and a plurality of deck support springs arranged between said deck and said frame so as to yieldably support said deck on said frame, at least one of said springs comprising a unitary body formed of spring wire and having a deck attaching portion and a pair of vertically yieldable portions connected between said deck attaching portion and said frame, each of said yieldable portions having a vertically spiraling coil spring portion, a substantially straight upright column portion, and a foot portion, said coil spring portion being connected between said attaching portion and said upright column portion and said upright column portion being connected between said coil spring portion and said foot portion so as to yieldably support said attaching portion.

2. The assembly according to claim 1 wherein said yieldable portion further comprises a horizontal moment arm portion connected between said coil spring portion and said upright column portion.

3. The assembly according to claim 1 wherein said deck includes a plurality of substantially straight deck wire members arranged crisscross fashion, some of said wire members extending lengthwise of said frame and others of said wire members extending crosswise of said frame, and said deck attaching portion comprises a pair of spaced apart straight torsion bars each having one end connected to the other by a common connecting section, each torsion bar being adjacent and attached to one of said deck wire members.

4. The assembly according to claim 3 wherein said torsion bars are generally parallel to each other and attached to adjacent parallel deck wire members.

5. The assembly according to claim 4 wherein said connecting section has a pair of parallel connecting segments perpendicular to said bars, said segments being connected together by an intermediate segment parallel to said bars.

6. The assembly according to claim 5 wherein said upright column portions downwardly converge and said column portions deflect outward under an applied downwardly directed load, said upright column portions absorbing a portion of said load.

7. The assembly according to claim 2 wherein said upright column portions downwardly converge, said column portions moving to a vertical orientation as said spring is deflected to limit the deflection of said spring.

8. The assembly according to claim 7 wherein said moment arm portion applies a vertical twist to said upright column portion as said spring is deflected to full closure.

9. The assembly according to claim 8 wherein said deck attaching portion comprises an intermediate attaching section extending perpendicularly between a pair of parallel connecting sections joining each end of said attaching section to one of said coil spring portions.

10. The assembly according to claim 9 wherein said deck includes a plurality of substantially straight deck wire members arranged crisscross fashion and said intermediate attaching section is parallel and adjacent one of said deck wire members and under the intersection of a pair of said crisscrossed wire members.

11. The assembly according to claim 1 wherein said foot portions are generally U-shaped horizontal sections each having a pair of spaced leg portions.

12. The assembly according to claim 1 wherein said foot portion comprises a base bar attached to said frame, said base bar having a pair of base torsion bars extending perpendicularly from said base bar in a generally horizontal plane and said deck attaching portion includes a pair of ends attached to said deck.

13. In a box spring assembly of the type having a supporting frame with a mattress support deck assembly supported above said frame by an array of springs, at least one of said springs comprising:

a foot portion having a base bar and a pair of base torsion bars extending from said base bar in a generally perpendicular direction therefrom and lying substantially within the same plane as said base bar;

a deck attaching portion having a pair of attaching bars and a pair of curved torsion bars joining said attaching bars and extending and lying within the same plane thereof; and a yieldable portion having a pair of horizontal moment arms and a pair of connecting wire columns extending downward from each of said moment arms to join said base torsion bars and a pair of wire coil spring sections extending upward from each of said moment arms to said curved torsion bars.

14. The spring according to claim 13 wherein said deck attaching portion further comprises a pair of end bars connected to said attaching bars and extending at an obtuse angle therefrom.

15. The spring according to claim 13 wherein said spring is formed from a single piece of wire stock and wherein the ends of said single piece of wire stock are within said deck attaching portion.

16. The spring according to claim 15 wherein said connecting wire columns diverge from said foot portion and move to a further divergent position from an upright vertical position when said spring is deflected to limit the full deflection of said spring.

17. The spring according to claim 13 Wherein the cross sectional areas swept out by said portions increases progressively from said foot portion to said yieldable portion to said deck attaching portion, said spring outlining an unobstructed inside cavity whereby a plurality of said springs may be stacked together.

18. In a box spring assembly for supporting bedding loads having a frame and a mattress support deck spaced from said frame, a wire spring member interposed between said frame and said deck, said spring member having an upper end and a lower end yieldably resisting a downwardly directed load on said spring tending to move said upper end toward said lower end, said spring member having a pair of coil spring portions coiled in the same direction and connected to said upper end, and a pair of downwardly extending generally straight column portions extending downward from said coil spring portions and connected to said lower end so that each column portion is subjected to torsional stresses resulting from torsional loading on said coil spring portion resisting said load on said spring member.

19. The spring member according to claim 18 wherein said coil spring portions terminate in a pair of hook shaped free ends at said upper end attached to each other forming a generally circular upper end.

20. The spring member according to claim 18 wherein said column portions are connected together at said lower end by a generally horizontal common connecting portion.

21. The spring member according to claim 20 wherein said connecting portion includes a pair of spaced base bars which can function as lower moment arms to enhance the ability of the column portions to resist torsional stresses.

22. The spring member according to claim 18 wherein said downwardly extending column portions each has a generally horizontal moment arm section and an upright column section, said moment arm section being connected between said coil spring portion and said upright column section, said column portions bending toward each other toward a vertical orientation to resist said load.

23. The spring member according to claim 18 wherein said downwardly extending column portions each has a generally horizontal moment arm section and an upright column section, said upright column sections twisting away from the upright position to resist said load.

* * * * *